US005500258A

United States Patent [19]

Young

[11] Patent Number: 5,500,258

[45] Date of Patent: Mar. 19, 1996

[54] EDGE-FOLDED GARLAND

[75] Inventor: Kevin Young, Bensalem, Pa.

[73] Assignee: F.C. Young & Co., Inc., Yardley, Pa.

[21] Appl. No.: 298,267

[22] Filed: Aug. 31, 1994

[51] Int. Cl.[6] ..... A47G 1/00

[52] U.S. Cl. ..... 428/10; D11/119; 493/958

[58] Field of Search ..... 428/7, 10; 493/958; D11/119, 120; 362/122

[56] References Cited

U.S. PATENT DOCUMENTS

| | | | |
|---|---|---|---|
| D. 354,019 | 1/1995 | Young | D11/119 |
| 2,234,338 | 3/1941 | Franke | 428/10 X |
| 3,637,452 | 1/1972 | Sanders | 428/10 |
| 3,846,212 | 11/1974 | Rodermund et al. | 428/10 X |
| 3,852,868 | 12/1974 | Rodermund et al. | 428/10 X |
| 4,963,411 | 10/1961 | Protz, Jr. | 428/123 |
| 5,091,226 | 2/1992 | Protz, Jr. | 493/958 X |
| 5,156,893 | 10/1992 | Barthe | 428/10 X |

*Primary Examiner*—Henry F. Epstein
*Attorney, Agent, or Firm*—Gregory J. Gore

[57] ABSTRACT

A tinsel-type garland has outwardly-directed reflecting surface areas created by permanently creasing the free ends of the tinsel needles to form tabs bent at an angle of approximately 90-degrees from the shank of the needle. The formation of these tabs orients their surface approximately tangent to the radial array of needles and, thus, faces a plurality of reflective surfaces directly toward the viewer. Only a small additional amount of material is needed to form the tabs which aid in obscuring the center core of the garland. Hence, less compacting of the web may be needed, thus offering an additional cost saving by reducing the amount of material needed to visually fill out the garland. This construction provides a distinctive appearance, especially when mirror-like, highly-reflective metallic web material is used to form the needles.

8 Claims, 5 Drawing Sheets

FIG. 7
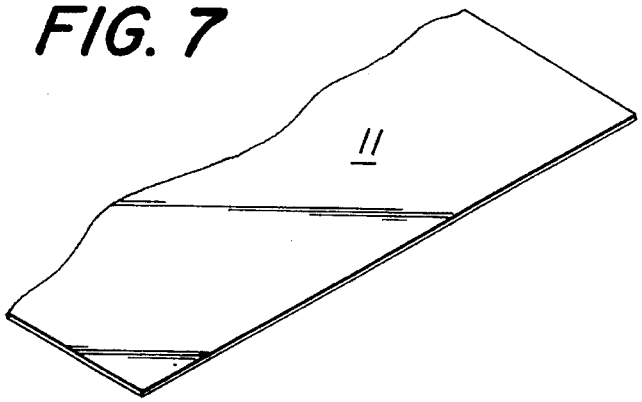
FIG. 8
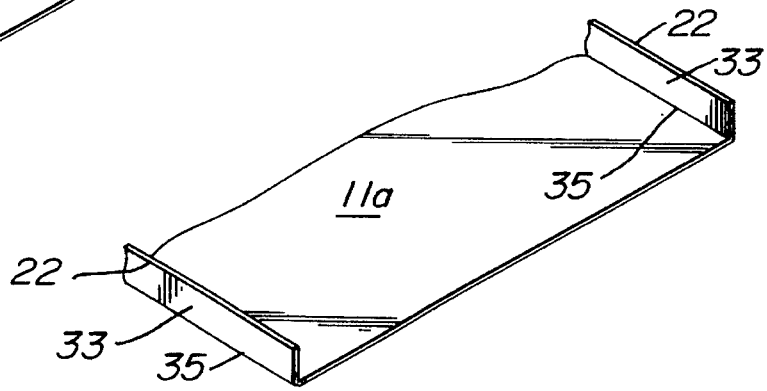
FIG. 9
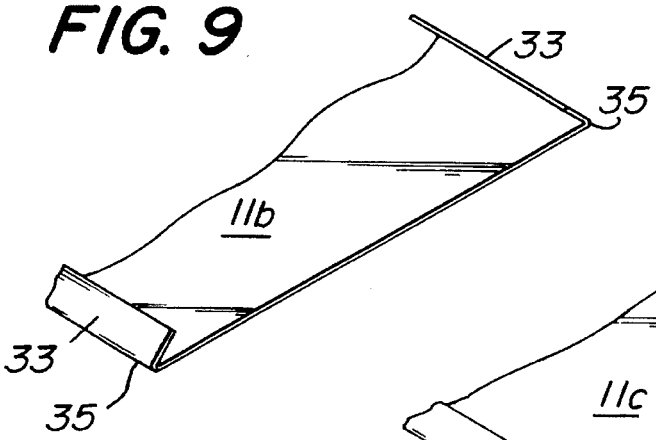
FIG. 10
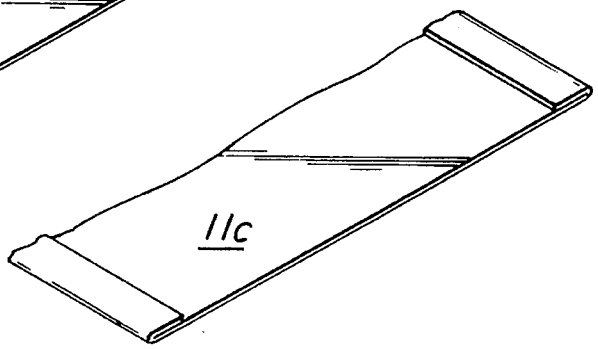
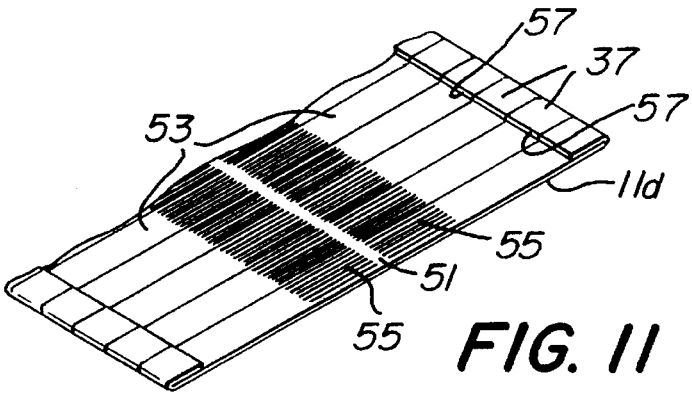
FIG. 11

EDGE-FOLDED GARLAND

FIELD OF THE INVENTION

This invention relates to decorative garlands. More specifically, the invention is directed to a decorative garland which is manufactured from a web of film material that is transversally cut and then twisted about support wires to produce a tinsel-like ornamental string which may be used for decorating various structures, such as holiday trees.

BACKGROUND OF THE INVENTION AND DESCRIPTION OF PRIOR ART

Previous decorative garlands of the tinsel type have been made in a variety of densities and colors with different combinations of needle lengths and widths. It is also known to combine tinsel needles made from separate webs of material cut to different widths and lengths into the same garland. Many of the materials used are metallic-coated plastic films which are highly light-reflective to enhance the visual sparkle effect of the tinsel garland.

Tinsel garland manufacturing methods typically include feeding an elongate fiat film web through a rotary cutter which slices through the film web transversaily, except for a narrow uncut portion down the center of the film web which serves to hold the garland together alter cutting. The center section is usually called the "nerve", and as the film is processed, it is guided through the various processing stations of the garland-making machine by guides which act upon the nerve. After the film web is cut, it is directed into a twisting and compacting station where wires are applied to either side of the nerve and twisted about it. This processing station applies the wire at a greater linear speed than the feed of the wire, and this accomplishes a compacting of the film web so that the final appearance of the twisted garland is full and dense. The density may be changed by adjusting the rate of wire feed as desired and this process is called "stuffing".

Tinsel garlands are, however, limited in their appearance because of the fact that the reflective surfaces of the needles emanate radially from the center of the garland. Hence, light is directly reflected back at the viewer only along the sides of the garland allowing the less attractive center core section of the garland to be too visible. This can be overcome to some extent by increasing the density of the garland by stuffing, however, this results in a garland which is too heavy and expensive.

Another solution has been the addition of loops into the garland which are twisted into the garland central core. The loops are in the form of bows which emanate radially from the center of the garland. At their outermost point where the direction of the loops returns toward the center of the garland, a small amount of surface area facing the viewer is produced. This provides additional direct reflection of light which helps obscure or visually fill out the central core of the garland. Adding additional web material needed to form the loops is expensive, especially considering the small amount of surface area of the loop which actually reflects light directly back to the viewer. Too, the resulting garland is very heavy. Lighter garlands are preferred because they can be draped with less tension and they place less weight upon supporting structures, such as delicate tree limbs.

A prior use of longitudinal creasing of tinsel web needles is employed in a garland named "Reflections", which is produced by F.C. Young & Co., Inc. However, the creasing of the needles on this garland does not substantially bend the shank of the needle so that a portion of it faces the viewer.

Rather, the needles of this garland include multiple, parallel longitudinal creases creating small, alternating bends in opposite directions which maintain the overall radial orientation of the free ends of the needles. The result causes the needles to appear wrinkled and does not help obscure the central core of the garland.

Prior art patents which further explain the garland-making process include U.S. Pat. No. 3,852,868 issued to Rodermund et al and U.S. Pat. No. 3,637,452 issued to Sanders, which are hereby included by reference as though fully set forth. Neither patent teaches or suggests bent needles having light-reflecting tabs or folding over the edges of the web prior to cutting.

Hence, there is a need in the garland arts for a garland which has a full appearance that is inexpensive to manufacture, yet is lightweight and has a large amount of directly reflecting surface area that obscures the center core area of the garland.

SUMMARY OF THE INVENTION

The present invention provides the desired outwardly-directed reflecting surface areas in a decorative garland by permanently creasing the free ends of the tinsel needles so that the ends form tabs bent at an angle of approximately 90-degrees from the shank of the needle. The formation of these tabs orients their surface approximately tangent to the radial array of needles emanating from the center of the garland and thus faces a plurality of reflective surfaces directly toward the viewer. Adding these additional reflective surfaces require only a small additional amount of material equal to the length of the tabs. Hence, very little additional web material needs to be added to the garland, thus keeping the completed garland light-weight and inexpensive to produce. Furthermore, a distinctive appearance is created in which the reflective tabs become visually dominant. This is particularly true when mirror-like, highly reflective metallic web material is used to form the garland. As normally viewed, the added tabs obscure the center core of the garland and less compacting of the web may be needed, thus offering an additional cost saving by reducing the amount of material needed to visually fill out the garland.

More specifically, the present invention comprises a garland formed from a film web, the garland having a plurality of radially-projecting needles, at least some of which are permanently bent at an angle along a longitudinal foldline adjacent each edge of the film web producing outward-facing tabs at the free ends of the needles. The needles and tabs are formed by folding and then creasing at least one longitudinal side portion of the web along the foldline and then cutting the web transversally. The angle forms a residual tab angle in the range between 70-degrees to 110-degrees of included angle measured between the tabs and the shanks of each needle respectively. The garland is formed by twisting a cut film web along an axis about wires creating a substantially cylindrical garland having radially-projecting needles emanating from a central core. The tinsel garland further includes a second cut film web having a plurality of needles, the web being twisted together with the first film web about its axis. The needles of the first film web may be wider than the needles of the second cut film web, and the needles of the second web need not be creased. The material of the first film web is preferably highly reflective and includes a centrally located longitudinal uncut portion which lies along the axis of the garland. The method of making a tinsel garland comprises the steps of: providing a longitudinal strip of web material; folding at least one edge of the web material along a longitudinal foldline defining the boundary of a side portion so that the side portion is folded over face-to-face; creasing the web along the foldline by applying pressure to the opposite side of web; cutting the folded web transversally; and then twisting the web about a pair of wires along a central axis. Folding of the film web is achieved by a series of folding dies which first lift and then fold over face-to-face at least one side portion of the film web. Creasing the film web is achieved by a pair of opposing rollers forcibly applied to opposite sides of the web.

It is therefore the main object of the present invention to provide a tinsel-like garland with a unique appearance that is light-weight and inexpensive to produce. Other objects and advantages will be readily understood from the following drawings and description of the preferred embodiment in conjunction with the accompanying drawings.

BRIEF DESCRIPTION OF THE DRAWINGS

FIGS. 7, 8, 9, 10 and 11 are top-right front isometric views showing the shape of the film web resulting from the steps of folding, creasing and cutting the film web.

DESCRIPTION OF THE PREFERRED EMBODIMENT

Figure 1:
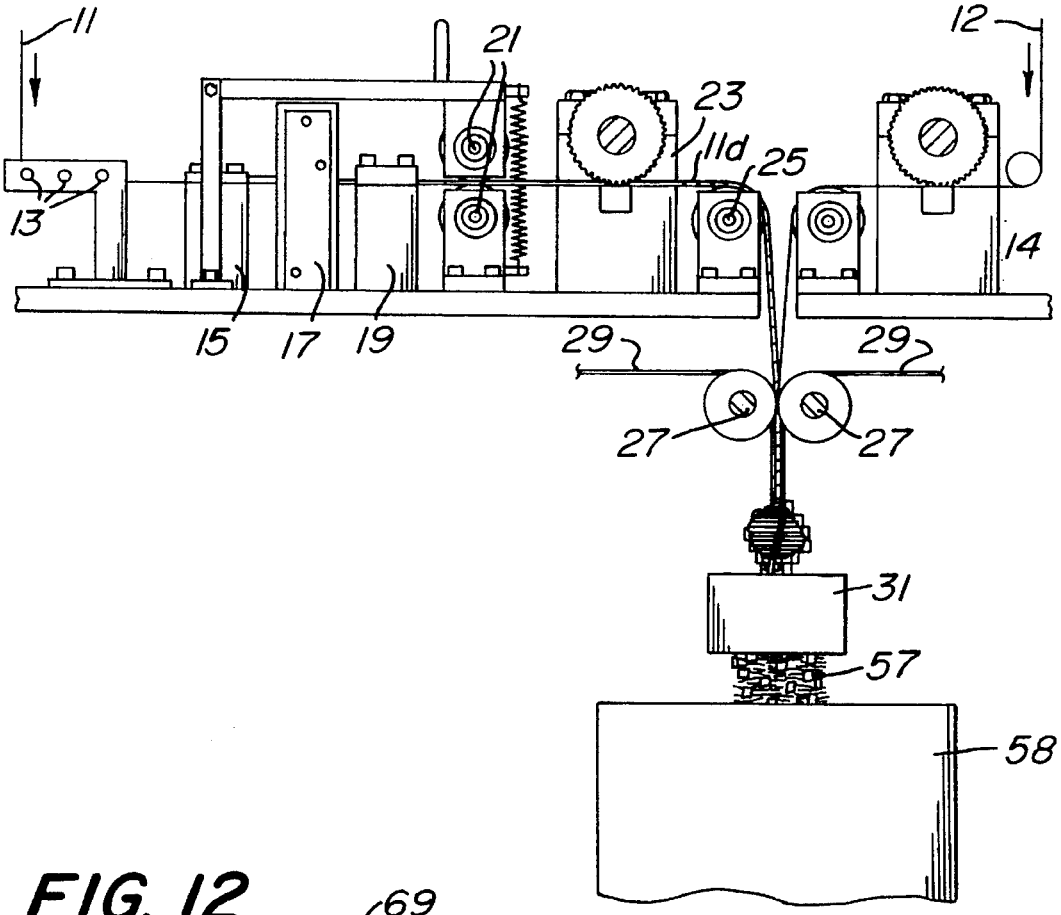
FIG. 1 is a front view of the manufacturing device used to produce the garland of the present invention.

Referring to FIG. 1, film web 11 is fed from a roll source not shown in this figure. The web is of indeterminate length, approximately 4-inches wide, and is typically a thin, flat PVC film as depicted in FIG. 7, approximately 0.0014-inches thick, which has been treated with a coating to provide a reflective surface.

Film 11 passes from the source downward into guide rollers 13 which transfer its direction to horizontal travel and also align the film web laterally as it enters the processing stations. The first process is a folding operation that is accomplished by three folding blocks or dies 15, 17, and 19. The folding blocks act primarily upon the edges of the film web which are folded over toward the middle, approximately ¼-inch. The folded web then passes through crease rollers 21 which form a permanent crease along foldlines parallel and adjacent to both longitudinal edges of the film web. The creased web then passes into cutting station 23 where a transverse-cut pattern is applied to the film web to form the individual tinsel needles and a central uncut portion which creates the nerve. The cut web then passes over pulley 25 which directs the web downward into draw rollers 27 at which point wires 29 are applied to opposite sides of the cut web approximately in the middle of the web along the nerve. In the nip of the draw rollers, the web is compacted and twisted about the applied wire. The twist is applied by rotating collar 31 and a garland-accumulating drum 58 which both rotate rapidly to pull and twist the garland 57 as it is formed.

In this embodiment, a second web 12 is shown fed from the right side of the machine which is ultimately applied to the creased web 11 at the point where they both enter the draw rollers 27. Web 12 is preferably provided with a different cut pattern from the first web in order to achieve a resultant garland having dual elements. Web 12 is cut in a cutting station 14 and preferably has conventional, even-spaced, fine-cut needles also with a central longitudinal nerve. This cutting of the second web is of the type most familiar to one of ordinary skill in the art. Both cutting stations 23 and 14 include cutting wheels with cooperating cutting blocks well known in the garland-making arts and, thus in themselves, form only a part of the present invention.

Figure 2:
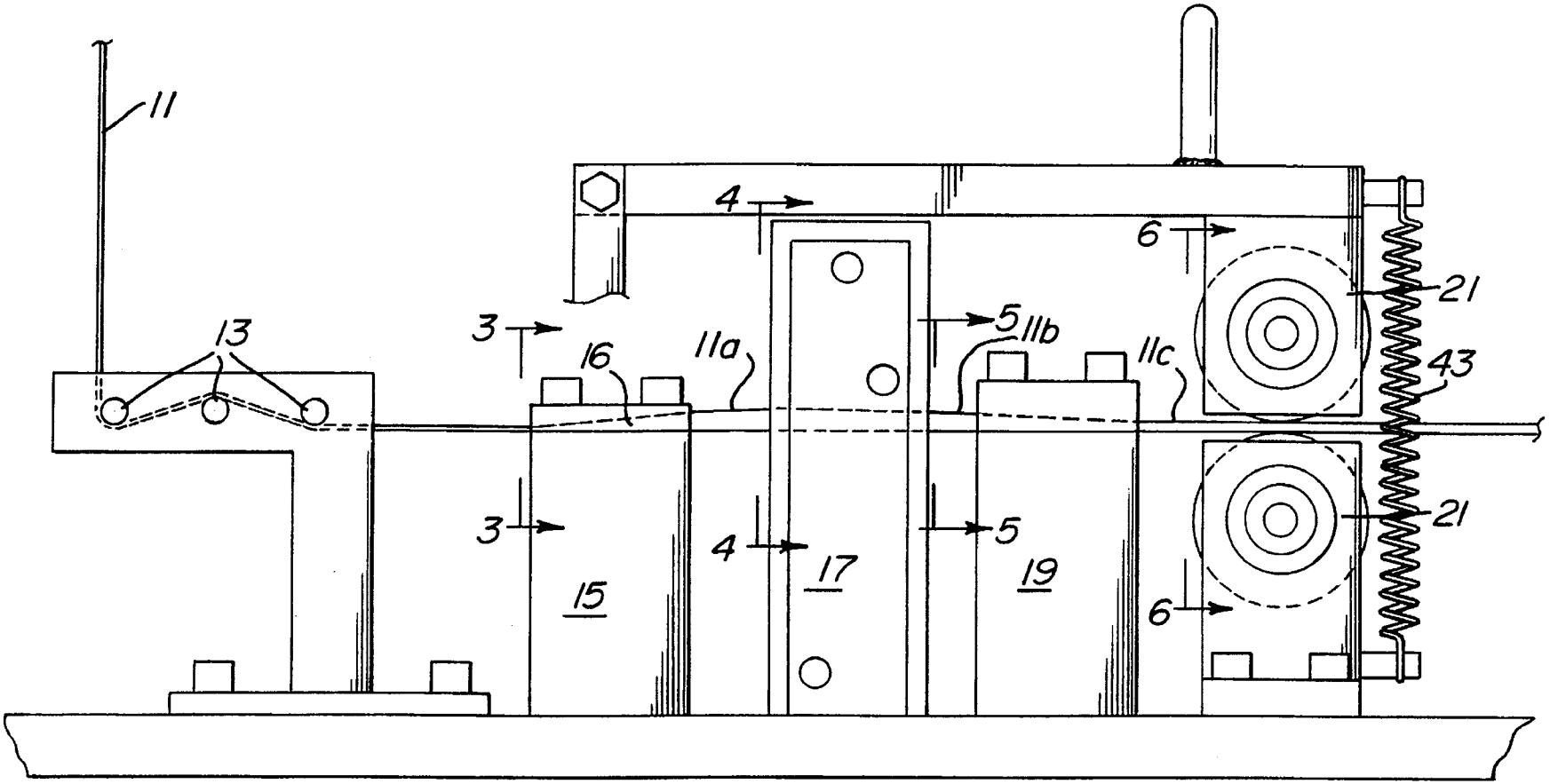
FIG. 2 is a close-up view of the folding station shown in FIG. 1.
Figure 3:
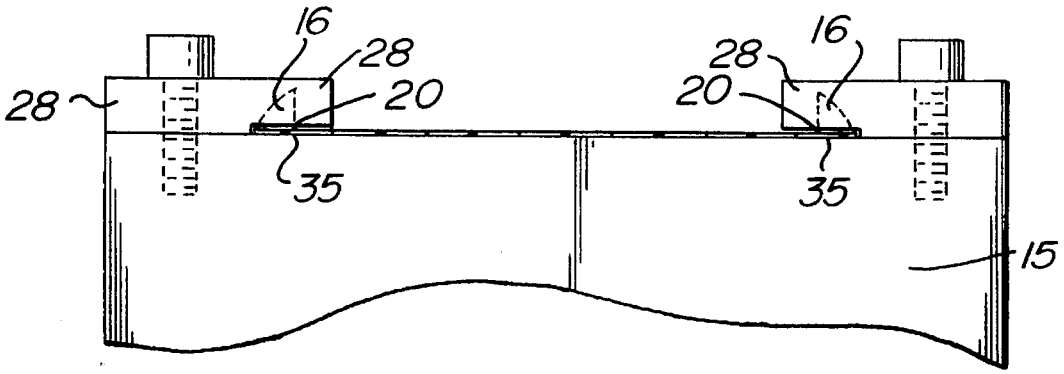
FIGS. 3, 4, 5 and 6 are left-side sectional views taken from FIG. 2 as shown in that figure.

Referring now to FIG. 2, a close-up view of the folding and creasing stations referred to in FIG. 1 above is shown. Web 11 in the flat condition shown in FIG. 7 passes first through folding block 15. Folding block 15 includes side ramps 16 which lift the edges of the web from horizontal to vertical into the shape shown in FIG. 8, where side portions 35 are formed. Bent side portions 33 lie between each foldline and the adjacent web edge 22. This structure is more clearly depicted in FIG. 3. Referring now to FIG. 3, side ramps 16 extend longitudinally along the length of the folding block and include inner-facing guide bars 28. The guide bars maintain the web from buckling in the middle as the edges are lifted by ramps 16 and a foldline 35 along each side of the web is created along an outside corner 20 of each guide bar.

Figure 4:
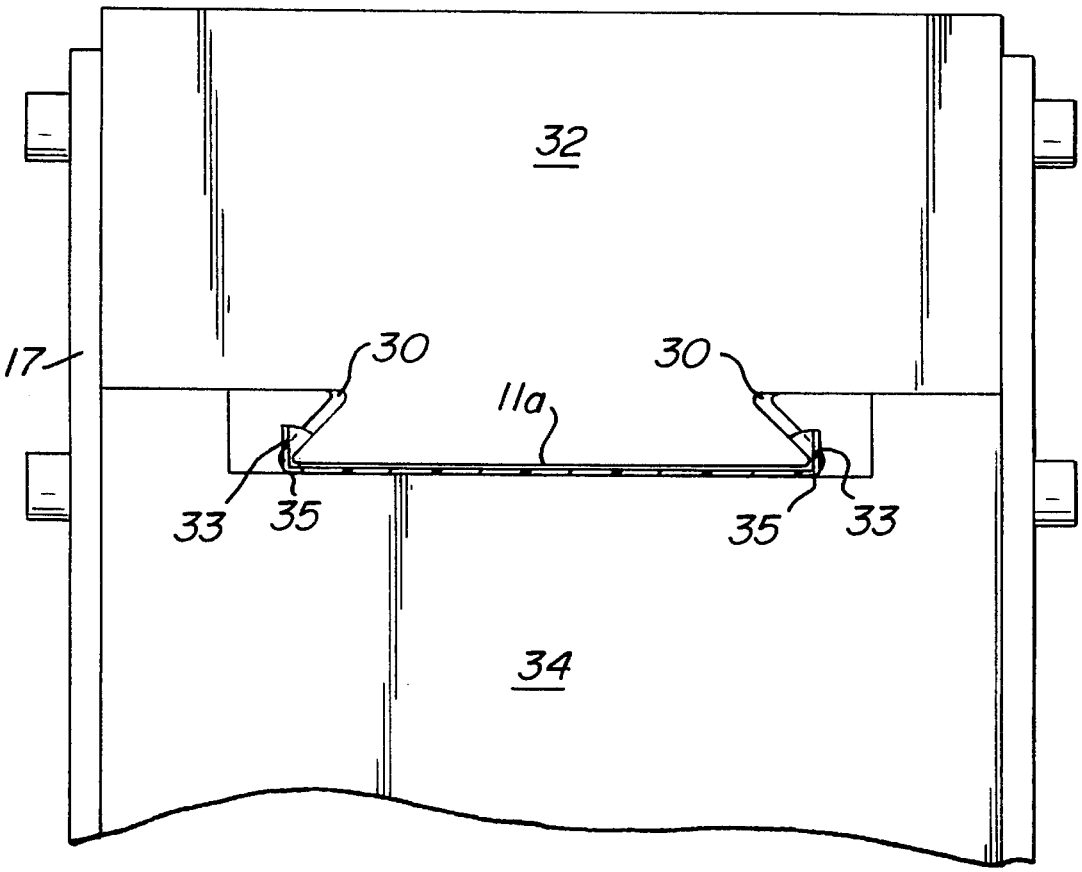

Referring again to FIG. 2, the film with longitudinal edges folded 90-degrees upward 11*a*, as shown in FIG. 8, now passes into a second folding block 17, a cross-section of which is shown in FIG. 4. Referring now to FIG. 4, folding block 17 includes closely-mating top and bottom halves, 32 and 34, creating a folding die with a gap in between the halves for passage of the film web. As shown in this figure, the web 11*a* enters the folding die with upright longitudinal side portions 33. The die halves are so formed that the gaps along the sides form downward sloping ramps that direct the web side portions 33 downward and inward as the web travels the length of the die. The web exiting folding block 17 has longitudinal side portions 33 which are folded inward along foldlines 35 approximately 45-degrees from horizontal as depicted in this figure and in FIG. 9 as web 11*b*.

Figure 5:
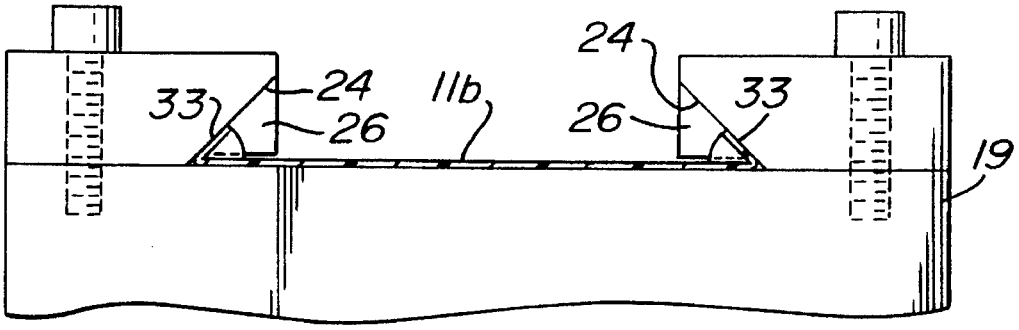

Referring now again to FIG. 2, a third folding block 19 receives the film web 11*b* from folding block 17 and completes the fold from 45-degrees to full horizontal so that the longitudinal side portions of the web are now completely folded over, face-to-face. This final folding structure is depicted in FIG. 5 which shows guide ramps 24 of die 19 that direct the 45-degree angle side portions 33 downward and inward until both side portions are completely folded over, face-to-face. Guide bars 26 secure the web from buckling upward as pressure is applied to the sides of the web through ramps 24. The shape of the web 11*c* as it leaves this final folding die is shown in FIG. 10 as web 11*c*.

Figure 6:
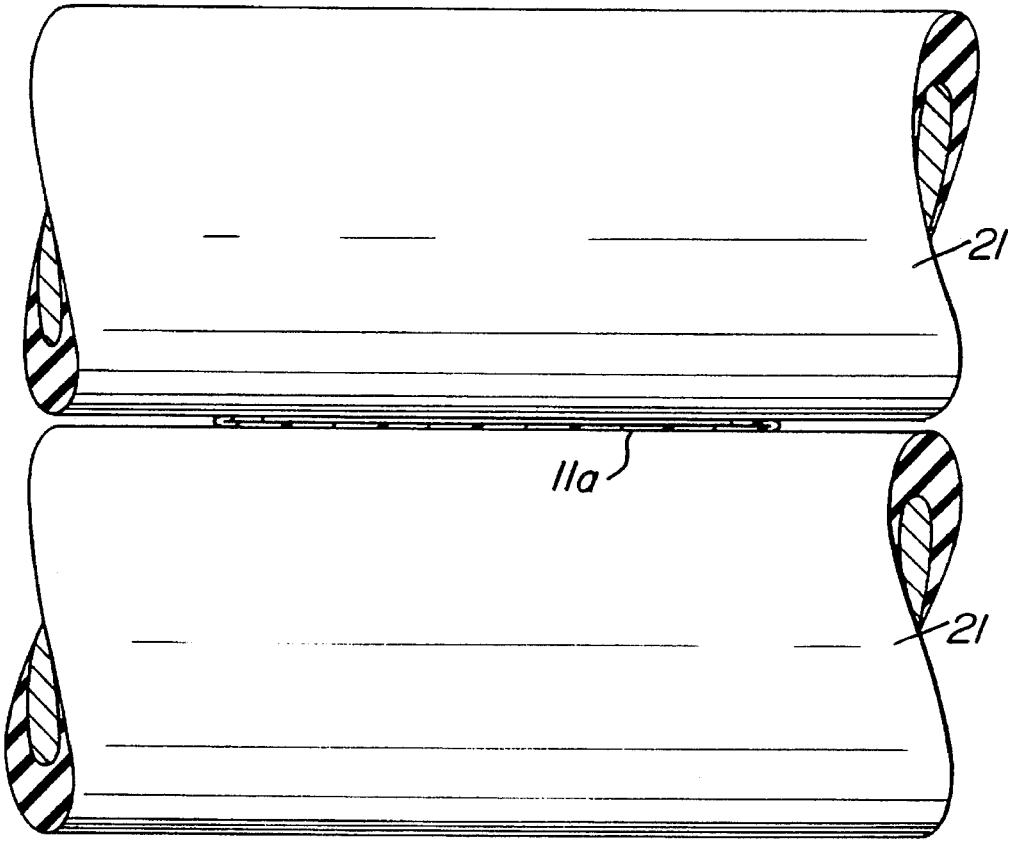

Referring once more to FIG. 2, the folded web 11*c* now enters crease rollers 21 which press against the folded web with a force supplied by spring means 43. Passage of the folded web into the crease rollers is more clearly shown in FIG. 6. The crease rollers are rubber idler rollers with sufficient pressing force selected with regard to the type and thickness of web material so that a permanent and lasting crease is formed along each longitudinal foldline. The exact roller compression force is selected by trial, changing the tension of spring 43 so that the edges remain bent over after creasing.

Referring again to FIG. 1, the web is then fed directly into a rotary cutter located in cutting station 23 wherein lateral cuts are applied to the folded web 11*c* in a pattern on web *d* shown in FIG. 11. Referring now to FIG. 11, this cut pattern includes a central, uncut longitudinal nerve 51. The cut pattern also includes wide-spaced transverse cuts 53 and finer transverse cuts 55 on either side of the nerve. The use of finer cuts on either side of the nerve aids twisting. After cutting, the web edge becomes the free ends 57 of the individual needles 37. Referring again to FIG. 1, the final cut web 11*d* is delivered over pulley 25 into draw rollers 27 where it is twisted together with a conventionally-cut tinsel web 12 described above to provide the resulting garland product 57 which is depicted in FIG. 12.

Figure 12:
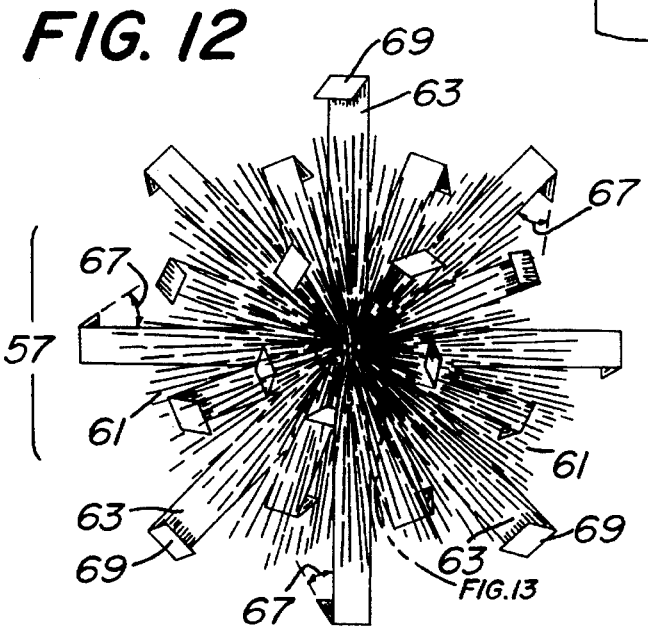
FIG. 12 is an isometric side view of the completed garland.

Referring to FIG. 12, the pressing force between crease rollers should be increased until a permanent bend of approximately 90-degrees is observed at the free ends of the cut needles in the resultant garland. It is one of the discoveries of the present invention that standard PVC film used in the tinsel garland-making arts is capable of permanently holding this extreme bend, thus forming the outward facing reflective tabs 69. Due to changes in the material along the web and other manufacturing variables, the residual tab angle 67, the angle between the tab and the shank of the needle, may vary; however, the resulting garland will be acceptable so long as the residual tab angle for a majority of the bent needles is in the range between 70-degrees to 110-degrees after twisting. Another unexpected result is that, after cutting, the bent needle ends are not crushed by the draw rollers. The folded over tabs require time to fully open to their desired residual position and the web moves at sufficient speed so that the tabs are not fully opened before entering the draw rollers.

Figure 13:
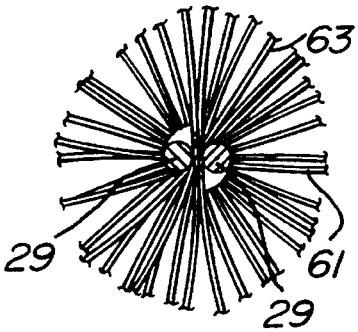
FIG. 13 is a close-up view of FIG. 12 showing construction of the center core of the garland.

The resulting garland includes the finely-cut tinsel needles 61 formed by the cutting and twisting of web 12 and the more broadly cut, bent needles 63 with tabs 69 which result from the creasing and cutting web 11 as described above. As seen in this figure, the needles 63 include bent tabs 69 which extend approximately tangential to the axis of the completed, substantially cylindrical garland. Many of the faces of these tabs will therefore be directed at the viewer providing a different angle of reflection than the other radial elements of the garland, thus producing a highly reflective speckled appearance of the web which adds a unique visual element to the ornamental appearance of the garland. FIG. 13 shows the construction of the central core of the garland in which the needle 63 and 61 are compacted and held tightly between twisted wires 29.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. A tinsel garland formed from a cut film web, comprising:

a plurality of needles, each having .a radially-projecting shank and being permanently bent at an angle along a transverse foldline adjacent free ends of said needles; and a plurality of outward-facing tab portions of said needles beginning at said foldline and terminating at the free ends.

2. The tinsel garland of claim 1, wherein a residual tab angle measured between the tabs and shanks of each needle is in the range between 70-degrees to 110-degrees.

3. The tinsel garland of claim 2, wherein said cut film web is held between wires along an axis of a substantially cylindrical garland with said radially-projecting needles emanating from a central core.

4. The tinsel garland of claim 3, further including a second cut film web having a plurality of needles held together with said first film web between said wires about said axis.

5. The tinsel garland of claim 4, wherein said needles of said first film web are wider than the needles of said second cut film web.

6. The tinsel garland of claim 5, wherein the needles of said second web are not bent.

7. The tinsel garland of claim 6, further described in that the material of said first film web is highly reflective.

8. The tinsel garland of claim 7, wherein said first film web includes a centrally located longitudinal uncut portion which lies along said axis of the garland.

* * * * *